United States Patent [19]

Altman

[11] Patent Number: 4,727,698

[45] Date of Patent: Mar. 1, 1988

[54] FIREPLACE SURROUND ASSEMBLY AND METHOD

[75] Inventor: Michael L. Altman, Sacramento, Calif.

[73] Assignees: Charles M. Gonder; Rosella M. Gonder, both of Rancho Cordova, Calif.

[21] Appl. No.: 895,275

[22] Filed: Aug. 11, 1986

[51] Int. Cl.[4] ..... F24C 15/12

[52] U.S. Cl. ..... 52/314; 52/211; 126/139

[58] Field of Search ..... 126/138, 139; 52/218, 52/314, 315, 316, 126.1, 127.3, 211

[56] References Cited

U.S. PATENT DOCUMENTS

| | | | |
|---|---|---|---|
| 7,253 | 4/1850 | Tucker | 126/138 |
| 269,536 | 12/1882 | Page | 126/138 |
| 688,764 | 12/1901 | Weyant | 52/584 |
| 1,711,026 | 4/1929 | Kline | 52/314 |
| 1,961,627 | 6/1934 | Wilber | 52/314 |
| 2,472,221 | 6/1949 | Malthouse | 52/314 |
| 3,228,387 | 1/1966 | Milan | 52/218 |
| 3,460,525 | 8/1969 | Bryant | 52/218 |
| 3,690,076 | 9/1972 | Harris | 52/314 |
| 4,254,596 | 3/1981 | Wright et al. | 52/218 |

*Primary Examiner*—Henry E. Raduazo

*Attorney, Agent, or Firm*—Flehr, Hohbach, Test, Albritton & Herbert

[57] ABSTRACT

A surround assembly for a fireplace includes a pair of leg members, a lintel and a hearth member, all separately fabricated from a brick-simulating material which is cast to provide brick-like shapes with recesses therebetween. The recesses are of sufficient depth to receive fasteners, such as bolts, and to accept grout thereover to mask or hide the fasteners and enhance the final appearance of the installed surround. The recesses terminate in a web of the brick-simulating material which rigidly interconnects the brick-like shapes. The various surround components are assembled with layers of grout positioned between the components to permit positional adjustment or shimming of the components in three dimensions to accommodate irregularities in the fireplace opening. A method of installing the surround components in which they are fastened to a support wall, shimmed relative to each other and the wall and grouted also is disclosed.

2 Claims, 3 Drawing Figures

FIREPLACE SURROUND ASSEMBLY AND METHOD

BACKGROUND OF THE INVENTION

1. Field of the Invention

The present invention generally relates to fireplace installations and, more particularly, to assemblies for surrounding fireplaces.

2. State of the Art

The brickwork or masonry around the opening in a fireplace is generally referred to as a "surround". One purpose of providing a surround is to thermally insulate the firebox portion of the fireplace from adjacent walls in which the fireplace is mounted to prevent charring or burning of wooden portions of the wall construction. Another, and equally important purpose of providing surrounds is to aesthetically enhance the appearance of fireplace installations.

The conventional method of forming a fireplace surround is to have a mason lay up bricks one-by-one to build a solid brick surround; however, as labor costs have increased, the cost of building solid brick surrounds has become quite substantial. Furthermore, not only is the cost of materials and labor for construction of solid brick surrounds high, but there may be the added necessity of reinforcing the supports for the fireplace because of the weight of the surround. Particularly in instances where surrounds are placed in existing residential structures, including situations where new surrounds are retrofitted about existing fireplaces. Floor joists and other supporting members on which a conventional fireplace and hearth surround are placed often must be substantially reinforced.

There have been attempts to provide fireplace surround assemblies that have the appearance of real brickwork but are made from artificial materials. Typically, such artificial surround assemblies have been molded from cement compounds that simulate the texture of actual brick and then have been colored with dye or paint to imitate the appearance of a brick surround. For purposes of installation, such molded surrounds are usually cast as two units, the vertical legs and lintel unit and a horizontal hearth, and the units are positioned around a fireplace opening and secured in place by a combination of adhesives and fasteners.

Unfortunately, artificial surround assemblies as heretofore known have had an appearance which usually readily reveals the artificial nature of the surround. That is, attempts to simulate the appearance of real brick have been largely unsuccessful and, further, prior methods and means for securement of surrounds to walls adjacent a fireplace opening have usually been unsightly upon close inspection. Additionally, when artificial surrounds have been used for retrofitting existing fireplace facings, installation problems that are costly and time consuming arise where the hearth or adjacent walls are not plumb.

An example of a prefabricated surround for a fireplace is set forth in U.S. Pat. No. 3,228,387 to Milan. The patentee discloses a fireplace assembly comprising a hearth and surround with the surround being formed as a single piece fabricated from a lightweight material which attempts to simulate real brick. To fabricate the surround, the patentee suggests utilizing brick facing members which are positioned in a mold, grouted and cast with a perlite-cement mix (15 to 65 pounds per cubic foot) on the backface of the surround to form a single structural unit. According to the patentee, spacing elements are utilized to provide recesses in the grout similar to recesses which would occur if a bricklayer used actual bricks to form the surround.

Another example of a fireplace surround is taught in U.S. Pat. No. 688,764 to Weyant. This patent shows a surround which is formed of two sheetmetal legs jointed to a separate sheetmetal lintel to define a mantel-facing for a fireplace. The leg and lintel portions of the surround are connected by bolts or the like. According to the patentee, the sheetmetal can be enameled, glazed, painted, embossed or otherwise ornamented in imitation of tiling.

Also in the prior art, U.S. Pat. No. 4,254,596 to Wright et al discloses a fireplace mantelpiece which is comprised of separate elements that can be shipped and stored in disassembled condition and later assembled to form a complete mantelpiece. As set forth in the patent, the mantelpiece assemblage includes a shelf or mantel for positioning above a fireplace together with side elements for support of the mantel and one or more face elements. The various elements, according to the patent, can be fastened together by snap lock connectors.

A prefabricated, multi-panel, masonry firebox is set forth in U.S. Pat. No. 3,460,525 to Bryant. The firebox is assembled from separate panels including a floor section, a pair of side sections, lower and upper back sections and a smoke deflecting roof section. According to the patent, the panels are connected together in assembled condition by tie wires and tabs embedded in the panel sections.

Still another example of a multi-panel, prefabricated fireplace is shown in U.S. Pat. No. 4,305,374 to Taylor. This patent teaches that the inwardly facing surfaces of wing panels in a prefabricated fireplace can be provided with an embosse brick pattern for decorative effect and enhanced structural rigidity. The hearth of the fireplace is formed as a refractory slab which rests upon, and is entirely supported by horizontal flanges which extend from the side and rear walls of the inner shell of the fireplace structure.

SUMMARY AND OBJECTS OF THE INVENTION

Among the objects of the present invention is the object of providing a fireplace surround assembly that can be easily retrofitted to existing installations to produce an appearance that is almost indistinguishable from an actual brick surround, and which can be easily installed by relatively unskilled workmen.

Further, an object of the present invention is to provide a method for assembling a fireplace surround such that the assemblage has an appearance of being formed from actual brick but which can be installed at considerable savings in time, labor and expense.

Another object of the present invention is to provide a fireplace surround which is durable, easy to maintain, requires minimal tools to install and can be employed in old and new structures.

More specifically, an object of the present invention is to provide a fireplace surround assembly which is assembled preferably from four separately fabricated components and which can be installed in a manner which allows shimming or adjustment of the placement of the components in three dimensions to accommodate geometrically uneven conditions, such as lack of plumb or other irregularities around fireplace openings.

In accordance with the preceding objects the present invention provides a fireplace surround assembly molded in four separate sections, each fabricated from a brick-simulating material having substantial density, e.g. 100–120 pounds per cubic foot. In the preferred embodiment, the four separately fabricated components include a pair of leg members, a lintel member for mounting across the pair of leg members, and a hearth member for horizontal disposition between the pair of leg members. Each of the separately fabricated components is cast from the brick-simulating material to provide brick-like shapes with grout-accepting recesses formed therebetween of sufficient depth to accept substantial grout between the brick-like shapes while providing a web which rigidly and integrally interconnects the brick-like shapes. The preferred embodiment further includes grouted shim joints for generally nonforaminously connecting the components to one another in selectively adjustable relationship in three dimensions.

The method of the present invention comprises, in summary, the steps of casting components of brick-simulating material to provide brick-like shapes with grout-accepting recesses therebetween while providing a web of the brick-simulating material to rigidly interconnect the brick-like shapes, forming the cast components to include at least a pair of leg members, a lintel and a hearth, then mounting the components about a fireplace opening by placing grout between adjacent ones of the components to provide positional adjustment in three dimensions. To finish the surround, grout can be placed within the grout-accepting recesses to obscure any devices utilized to attach the surround to an adjoining wall.

In accordance with the preceding, an advantage of the present invention is the provision of a fireplace surround assembly that can be easily retrofitted to existing installations, which has an appearance that is almost indistinguishable from a brick surround, and which can be easily installed by relatively unskilled workmen.

Further, an advantage of the present invention is the provision of a method for assembling and installing fireplace surrounds such that the assemblage has an appearance of being formed from actual brick but which can be installed with adjustments in position in three dimensions to complete an installation at considerable savings in time, labor and expense.

The foregoing and other advantages of the present invention will become readily apparent to workers skilled in the art upon consideration of the following description and reference to the appended drawings which illustrate a preferred embodiment of the invention.

IN THE DRAWINGS

DETAILED DESCRIPTION OF THE PREFERRED EMBODIMENT

Figure 1:
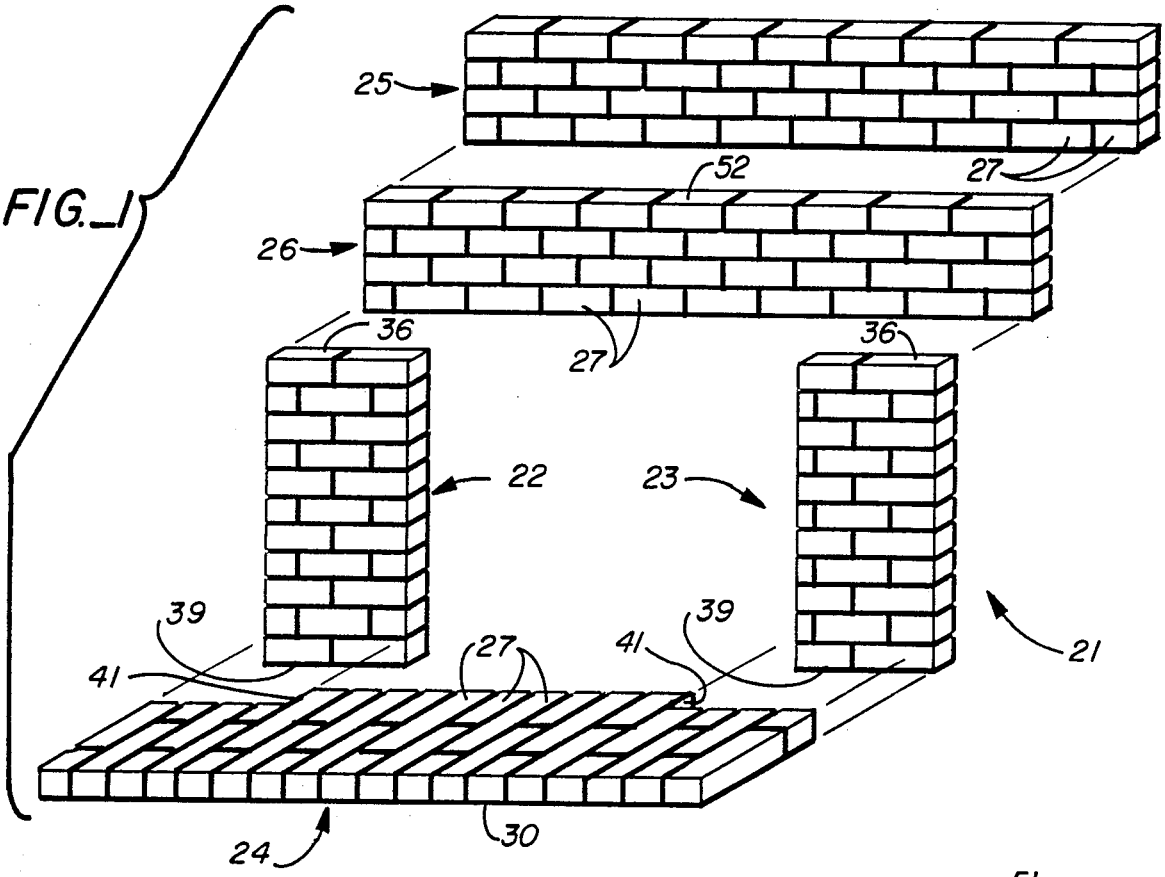
FIG. 1 is an exploded, top perspective view of a fireplace surround assembly according to the present invention.
Figure 2:
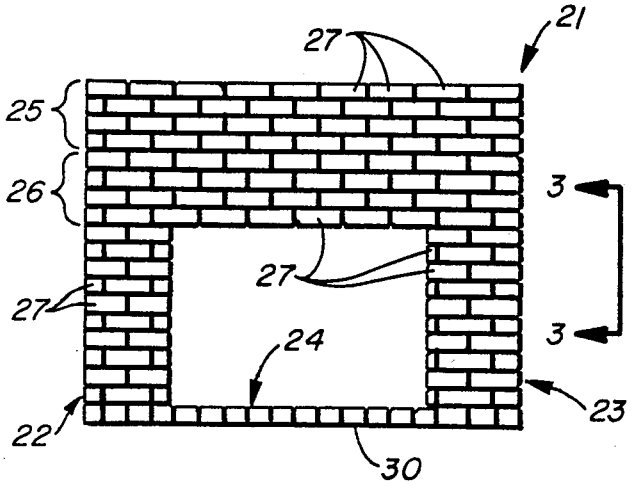
FIG. 2 is a front elevation view of the assembled fireplace surround in reduced scale.

Referring now to the appended drawings, a fireplace surround assembly 21 according to the present invention is preferably comprised of at least four interconnected components. In the illustrated surround there are five components, namely, a pair of upstanding leg members 22 and 23, a horizontal hearth member 24 fitted between leg members 22 and 23, and two lintel members 25 and 26 mounted to span between leg members 22 and 23. The five components are shown in exploded relationship in FIG. 1 to emphasize that each component preferably is individually prefabricated (i.e., factory-built) as a separate unit. In assembled condition, as shown by FIG. 2, lintel members 25 and 26 are at least partially supported by the spaced-apart leg members 22 and 23. Together, the lintel members and leg members 22 and 23 define a facing for a fireplace enclosure, inclusive of a firebox, not shown, fitted within the space between leg members 22 and 23. The floor in front of the fireplace preferably has a horizontally-disposed hearth member 24 positioned thereon. Typically, the lower edge 30 of hearth member 24 is flush with bottom edges 39 of respective leg members 22 and 23 although, as is discussed below, the method of assembly of the aforementioned components permits substantial adjustment or shimming in the position of the interconnecting components.

To fabricate the individual components or sections of the fireplace surround assembly (i.e., leg members 22 and 23, hearth member 24, and lintel members 25 and 26), each of the sections is formed by molding the section from a brick-simulating material. Molds for each section of the surround are created by forming a mold directly from bricks which are laid in the desired pattern and grouted. The grout does not extend to the front surface of the brick, but is recessed, as is set forth in more detail below. Prior to placing a molding material on the brick form, the bricks are lacquered and then coated with a mold release. A fiber glass molding material may be poured over the brick assembly to for the master mold for the particular surround component.

The master mold is stripped from the brick assembly and is ready for use as a master mold with a brick-simulating material to cast surround components. The master mold, therefore, provides a form for a plurality of brick-shaped forms 27, which are cast from the brick-simulating material and are held together as an integral unit or section by a web 28 of the brick-simulating material itself (as best may be seen at the bottom of FIG. 3). In practice, the preferred brick-simulating material used in the surround assembly of the present invention is a cement-based composition sold under the trademark HYDROCAL which when cast produces brick-simulating surround components having a density of about 100 to about 120 pounds per cubic foot. Such brick-simulating materials are well known in the industry and readily available from various commercial sources and can have a brick stain mixed therein. The particular material used to simulate brick-shaped forms 27 is not regarded as a novel portion of the present invention.

Figure 3:
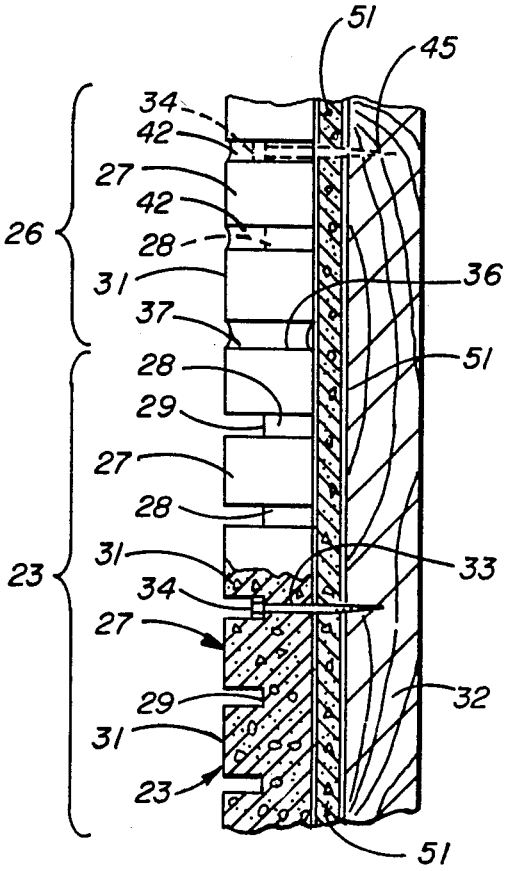
FIG. 3 is an enlarged, fragmentary, partially broken away, side elevation view in cross section of a portion of the fireplace surround assembly, taken substantially along the plane of the line 3—3 in FIG. 2.

In accordance with the fabrication process, FIG. 3 shows a plurality of brick-shaped forms 27 superposed, one above the other, in vertical series with each of brick-shaped forms 27 bonded to adjacent brick-shaped forms 27 by webs 28 of the brick-simulating material indicated. As also shown in FIG. 3, webs 28 terminate in surfaces 29 which are recessed from the front faces 31 of brick-shaped forms 27. The recesses are used during the process of assembling the sections of the fireplace surround into a unified structure.

While providing a plurality of surround sections is not regarded as novel per se, there are several advantages that result from the fact that the surround assembly of the present invention is molded in separate sections. One advantage is that the multiplicity of sections allows utilization of a relatively heavy or cement-type brick-simulating material, e.g., 100 pounds per cubic foot or more. Such substantial brick-simulating materials have the property of providing an appearance which more closely resembles conventional bricks than less substantial brick-simulating materials. Since molded brick surrounds previously have been formed, with integral legs and lintel, the brick simulating material preferably is relatively light in order to permit lifting and manipulation of the unitary surround assembly during installation. This requirement for a lightweight casting material in prior art surrounds becomes even more important as the height of the lintel increases. Unfortunately, lightweight brick-simulating materials tend to have a very artificial appearance. The multiple section construction of the fireplace surround of the present invention permits the use of realistic, although heavier, materials without inhibiting manipulation of each section by a single workman.

A description of the installation process of the surround of the present invention will illustrate the substantial advantages which accrue when employing the present surround. As a first step in the installation procedure, the size of the surround is determined by measuring the fireplace opening. Height differences can be easily accommodated by cutting legs 22 and 23 with a circular saw fitted with a carborundum blade. Next, the walls surrounding the fireplace opening should be cleaned and the studs 32 located.

The first components or panels which are installed will usually be legs 22 and 23, but prior to installation all components may be pre-mortared while laying on the floor. Preferably adhesive or mortar is then applied to the back side of the legs. Securement of legs 22 and 23 to the wall is preferably accomplished by using fastener means in addition to adhesives. Thus, lag bolts 33 pass through bores formed in webs 28, through sheet rock 51 and into stud 32 (FIG. 3) of wall means against which legs members 22 and 23 are to be secured. When the legs are positioned against the wall, bores may be drilled through webs 28 (and the wet mortar 42 over the webs) in alignment with studs 28. As above noted, recessed surfaces 29 are located substantially behind the exterior surfaces 31 of brick-shaped forms 27, and heads 34 of lag bolts 33, after installation, also will be located substantially inwardly of the front faces 31 of the brick-shaped forms 27.

After legs 22 and 23 have been bolted in place against wall 32, pre-molded lintel member 26 is positioned on the tops 36 of the legs. Before final positioning of lintel member 26, however, grout material 37 (FIG. 3) is laid across the top surfaces 36 of respective legs 22 and 23 so that lintel member 26 can be permanently seated onto the grout and bonded to the legs.

One advantage of forming the surround assemblage with lintel member 26 which is separate and apart from legs 22 and 23 is that the layer of grout material 37 on one leg member provides a shim joint which can be adjusted to have a different thickness from the layer of grout on the other leg member. In practice, this feature allows an installer to adjustably custom shim the lintel with respect to the legs and, thereby, allows an installer flexibility to accommodate retrofitting problems due to lack of plumb, uneven surfaces and other irregularities. Similarly, in practice, the bottom surfaces 39 of leg members 22 and 23 normall will have grout placed under them to provide a shim joint between the legs and a support surface. Obviously, this shimming takes place before fastening of the legs to the wall by bolts 33. Such grouting locations beneath leg members 22 and 23 also can be used, in combination with shim joint 37 or alone, for shimming of the position of the surround during installation to accommodate out-of-level situations.

In addition to being secured to legs 22 and 23 by grout, lintel member 26 is also preferably secured by bolts, such as lag bolt 45, to wall means 32 above the fireplace opening. Second lintel section 25 may be placed on top surface 52 of lintel 26, with grout being used to join the two members and provide further shimming. Second lintel 25 also preferably will be bolted to the wall proximate the fireplace. Obviously, still further lintel sections can be added to reach any desired lintel height.

After securing leg members 22 and 23 and lintel members 25 and 26, hearth member 24 is positioned with the inwardly extending brick protrusion section 41 abuttingly positioned between two leg members 22 and 23. Hearth member 24 can be secured in place to the floor of the fireplace opening by bolting, grout and/or adhesive. Again, grout is placed between the hearth and leg members to provide shim joints therebetween.

After securing in place the sections of the surround assemblage, bolt holes may be covered with grout and when the mortar is firm, a rake and trowel are used to provide the desired finish. The resulting grouted panel is shown in the top three rows in FIG. 3. Such placement of grout 42 in grooves 29 allows th installer to adjust the color and finish of the grout as desired and thus provide to the overall surround installation with a realistic and aesthetically-appealing appearance. Such placement of grout 42 completely obscures heads 34 of bolt fasteners 33 and 45, and also makes it extremely difficult to detect the shim joints 37 between the various sections of the surround.

Finally, during installation, grouting may be placed between sheet rock 51 and the various surround sections so that the surround is shimmed with respect to the support wall to provide a realistic appearance when viewed from the side.

Thus, shim joints between the legs and the floor, between the legs and the lintel, between the legs and the hearth, and between the legs-lintel and the support wall, allow the installer to use prefabricated surround sections of substantial size which are shimmed together and mounted proximate the fireplace opening with a great savings in time as compared to laying the surround brick-by-brick. The shimming in three dimensions nevertheless affords the surround assembly of the present invention considerable flexibility during installation. Typically, the cost of an installed surround of the present invention is about ⅓ the cost of a conventional brick surround.

The foregoing is considered as illustrative only of the principles of the invention. Because numerous modifications and changes will undoubtedly occur to those skilled in the art, the foregoing description should not be interpreted to limit the invention to the exact construction and operation shown and described. Accordingly, all suitable modifications and equivalents may be resorted to which fall within the scope and spirit of the present invention as defined by the claims which follow.

What is claimed is:

1. In a firplace surround assembly having a plurality of separate surround components including, a pair of leg members each having a lower end and an upper end, said leg members being mounted to extend vertically along wall means on opposite sides of a fireplace opening, a lintel member mounted across the upper ends of said leg members above said opening, and a hearth member mounted on floor means below said opening to extend between the lower ends of said leg members, each of said surround components being cast from a cement-based brick-simulating material to provide a plurality of brick-like shapes spaced apart by and defining grout receiving recesses therebetween, said recesses terminating in webs of said brick-simulating material which integrally and rigidly connect said brick-like shapes, fastener means mounted in said recesses and extending through said webs to secure at least some of said components to said wall means, and grout means positioned in said recesses over said fastener means and said webs, the improvement comprising:

said hearth member extending transversely in front of said lower end of each of said leg members and protruding inwardly between said lower end of each of said leg members to define a pair of notches in said hearth member dimensioned to and receiving said lower ends of said leg members and providing L-shaped grout joints therebetween;

grout means positioned in and filling said L-shaped grout joints between said lower ends of said leg members and said hearth member;

grout means positioned under said lower ends of said leg members and between said upper ends of said leg members and said lintel member and filling a shim joint supporting the position of said leg members with respect to said floor means and a shim joint supporting said lintel member with respect to said leg members; and grout means positioned between said components and said wall means and filling a shim joint between said components and said wall means.

2. The fireplace surround assembly as defined in claim 1 wherein, each of said leg members and said lintel member are provided by substantially rectangular prefabricated units having a plurality of brick-like shapes, and said hearth member is provided by a single prefabricated unit having a plurality of brick-like shapes to enable said fireplace opening to be encircled by said surround assembly by the assembly of only four prefabricated units.

* * * * *